US009945191B2

(12) United States Patent
Petrowsky et al.

(10) Patent No.: US 9,945,191 B2
(45) Date of Patent: Apr. 17, 2018

(54) HORSESHOE JACK FOR DRILLING, WORK-OVERS AND COMPLETIONS

(71) Applicant: 1440072 ALBERTA LTD., Red Deer (CA)

(72) Inventors: Conrad Petrowsky, Red Deer (CA); Thomas Follett, Red Deer (CA); Blake Johnson, Red Deer (CA)

(73) Assignees: 1440072 ALBERTA LTD., Red Deer (CA); Blake Johnson, Red Deer (CA)

( * ) Notice: Subject to any disclaimer, the term of this patent is extended or adjusted under 35 U.S.C. 154(b) by 42 days.

(21) Appl. No.: 14/813,730

(22) Filed: Jul. 30, 2015

(65) Prior Publication Data

US 2016/0032667 A1 Feb. 4, 2016

Related U.S. Application Data

(60) Provisional application No. 62/030,889, filed on Jul. 30, 2014.

(51) Int. Cl.

| | |
|---|---|
| ***E21B 19/08*** | (2006.01) |
| ***E21B 19/06*** | (2006.01) |
| ***E21B 19/07*** | (2006.01) |
| ***E21B 19/086*** | (2006.01) |

(52) U.S. Cl.

CPC ..... *E21B 19/08* (2013.01); *E21B 19/06* (2013.01); *E21B 19/07* (2013.01); *E21B 19/086* (2013.01)

(58) Field of Classification Search

CPC ..... E21B 19/08; E21B 19/086; E21B 19/06; E21B 19/07

See application file for complete search history.

(56) References Cited

U.S. PATENT DOCUMENTS

| | | | | |
|---|---|---|---|---|
| 4,023,449 | A | 5/1977 | Boyadjieff | |
| 4,585,079 | A | 4/1986 | Lemaire et al. | |
| 5,060,542 | A | 10/1991 | Hauk | |
| 5,931,238 | A | 8/1999 | Gilmore et al. | |
| 6,688,393 | B2 * | 2/2004 | Sredensek | E21B 19/02 166/377 |
| 7,188,548 | B2 | 3/2007 | Liess | |
| 7,264,066 | B2 | 9/2007 | Glas et al. | |
| 7,347,285 | B2 | 3/2008 | Hamner | |
| 7,438,127 | B2 | 10/2008 | Lesko | |
| 8,584,774 | B2 | 11/2013 | Connell | |

* cited by examiner

*Primary Examiner* — Yong-Suk Ro
(74) *Attorney, Agent, or Firm* — Bennett Jones LLP

(57) ABSTRACT

A jack and push/pull apparatus is provided by attaching to a wellhead an extendable/contractible horseshoe-shaped jack assembly of sufficient diameter to surround and act upon the tubing or casing to be manipulated in the well, the linear action of the assembly being powered between an extended and a retracted position, the assembly having at least one tube-gripping mechanism at the end of the assembly away from the wellhead attachment. Tubing is inserted into the well bore through the assembly and the wellhead, and when injection forces are desired tube-gripping means grip the tubing being injected and the apparatus is powered to a retracted position, forcing the grasped tubing into the well. The operation may be reversed to pull tubing or casing. The assembly can be simply added to the rig while tubing is present on and above the rig's floor.

2 Claims, 5 Drawing Sheets

HORSESHOE JACK FOR DRILLING, WORK-OVERS AND COMPLETIONS

FIELD OF THE INVENTION

Horizontal or deviated well operations can require the use of extra force to insert tubing into the well, as compared to forces used in substantially vertical wells, where gravity effects on tubular equipment often provide sufficient impetus. As deviated wells increasingly provide substantially longer non-vertical runs, the need for an ability to supply significantly more force to inject tubing into such wells increases.

In a lot of cases, pressure isolation is not required, and so lubricating fixtures in the prior art are too complex, having superfluous componentry, sealing mechanisms, and the like.

BACKGROUND OF THE INVENTION

An example of a system in the prior art includes Funk (U.S. Pat. No. 5,988,274), which describes a tubing lubricator/injector for pressure-sealed snubbing operations. A main goal of the Funk device is to hold wellhead pressure which is significantly higher than atmospheric pressure, and well gases or fluids which may be significantly different and potentially harmful, from escaping into atmosphere at surface through an uncontrolled wellhead during operations on a well (such as inserting or removing tubing from the wellbore). Funk provides a seal such as a blow-out preventer, at the top of a telescoping sealed housing to seal the annulus between the interior wall of the housing and the exterior wall of the tubing; the housing is sealed to the wellhead; the tubing's interior is sealed or plugged separately; as the tubing is moved into the wellbore, the housing retracts, telescopically, becoming shorter while remaining sealed; similarly, when the tubing is removed from the wellbore, the housing is extended telescopically, becoming longer while remaining sealed. The tubing is moved in stages, so that the annulus between the tubing and the housing is sealed to the wellhead and at the top blow-out-preventer or seal, maintaining segregation of pressure and gases or fluids while manipulating tubing into and out of the wellbore.

In a push/pull jacking system as disclosed in the snubbing device in Tucken (U.S. Pat. No. 8,640,767), where there is requirement for isolation of well pressure and gas or fluid from atmosphere, a jacking system is provided by attaching a push-pull jack stand on a drilling or service rig's floor with slips at or near the rig floor, and slips at an upper movable attachment point on the push-pull unit, the upper slips meant to grasp tubing being manipulated into or out of the well's bore through the wellhead, so as to overcome wellbore forces urging the tubing out of the wellbore. Tucken provides a mechanism for controlling those outward forces from the well on the tubing while moving the tubing into or out of the well's bore.

Other means that are presently used to overcome friction lock: for example, conventional snubbing units like those provided by High Arctic Energy Services, Precision Drilling Corp. Snubbing Services, Work-over and Snubbing-Halliburton, and Push/Pull devices such as Strata Energy Services—Push Pull Machine. All of the above mentioned equipment is large and complex equipment to operate, rig up/rig out and service. Also all the above equipment needs to be manned on a daily basis and suffers from slowed operations and more or less permanent fixturing interfering with rig floor operational spaces. Additionally, these prior art examples are limited by virtue of their designs to handling tubing with O.D. less than about 7". It is thus desirable to find a tubing jack with minimal moving parts, small size and simplicity of placement and removal from the rig's working areas, and simplicity of operation which would allow existing drilling/service crews be trained in less than one day, greatly reducing the cost of operation. Also, there is a need to avoid the inherent tubing size restrictions of the prior art devices. A concept of crews operating rental or leased equipment on the rigs has been practiced for a very long time. One such piece of equipment that crews have being operating over the last few decades that is much more dangerous to operate is a tubing power swivel. No rental company presently offers training of the personnel. It is desirable to offer this training and orientation to well operators and drillers, to promote a safer environment for all personnel involved.

SUMMARY OF THE INVENTION

It is desirable to overcome at least some of the shortcomings in the prior art. In particular, it is desirable to provide an ability to force the movement of tubing along the length of a wellbore with sufficient force to overcome friction, pressure, gravity or other forces supplied or applied to the tubing by or in the well during part or parts of its travel into or out of the wellbore. In situations where there is a substantial deviation of the wellbore from vertical orientation, as in horizontally drilled or similar wells, the operator cannot rely upon gravitational forces acting on the mass of the tubing string to pull the tubing all the way into the wellbore, and in those and similar cases, it is necessary to apply longitudinally pushing forces to the tubing to inject it into the well.

A U-shaped jacking apparatus surrounding the tubing is provided, fixed, directly or indirectly, to the wellhead or BOP at the bottom end, and to the tubing's outer surface at or near the top end of the jack. The apparatus can be powered to an extended and/or a retracted length.

A mechanism to provide additional forces to safely inject or strip tubing into or out of a well is provided by an apparatus comprising:

- a mount for connecting the apparatus to the well's wellhead at the lower end of the apparatus, the mount with a U-shaped passage through which the tubing or casing and any associated fittings may pass; fixed to the upper side of the mount, one end of at least one jack or hydraulic ram; fixed to the other end of the jack, a travelling mount with a U-shaped passage through which the tubing or casing and any associated fittings may pass, and on which slips or tube-gripping means may rest or be attached for periodically engaging the tubing or casing during portions of the apparatus' operation; and means to power the linear extension and contraction of the jack hydraulic ram to alter the distance between the two mounts while the tubing or casing and associated fittings are fixed or attached within the U-shaped passages of the above components, said passages being in substantial vertical alignment, and in working alignment with the wellhead.

The extendable and retractable unit employs a simple control mechanism and in one embodiment can be easily powered by tying into a hydraulic pump system with a simple, potentially remote, up/down control (at an operator's control stand) positioned by the driller's console or any convenient location. A separate independent power pack could be available in an alternative embodiment. The motive power can alternatively be by one or more electrically driven rotary motors, using a gear or ball-nut And screw or similar rotary to linear or linear power transmission systems. Other drive systems will be known to those skilled in the art. The rig operator will stroke the Horseshoe Jack unit up or down as necessary while sliding the tubing/casing into position.

This operation is very safe and simple and lost rig time will be reduced substantially, by as much as 75% or more. This equipment configuration and procedure can substantially reduce the overall cost on a per well basis.

Additionally, the unit can be quickly deployed on the rig floor and quickly demounted and removed, even while the tubing extends through its centre, due to its U-shaped mounting plates, merely by demounting the unit's attachment to the well-head or BOP and then removing the unit from around the tubing and then moving it off the rig floor's working area.

The U-shaped plate or plates of the invention can be provided with a gate, making it possible to surround the tubing with circular plates at intermittent spacing. This may be a useful way to provide rig protection or an anti-bending guide for the tubing to prevent buckling, or to provide extra structural strength to the device.

With the increasing numbers of horizontal wells, drilling operators are experiencing friction lock with intermediate casing. This casing is on a larger scale when comparing tubing that is used to complete and work over wells on the service side of the industry. Simple equipment is not available. Casing sizes (external diameters) are not a limiting factor for this Horseshoe Jack which can be engineered to fit the largest diameters, yet remain compact and user friendly, by changing the size of the U-shaped mounting plates.

A preferred length of the apparatus while compressed is 4'-7'. Although a longer stroke would speed up work over/completion, being able to work with the service rig's floor's limited expandable height is preferred. As for a drilling rig, the same height size allows the end user to keep the stump at a workable height for the crew to make connections. In some cases the unit might be too short. This is easily rectified by adding in a longer hydraulic ram, and spacers/stabilizers and if required, additional plates, to gain height if the unit or its stroke is too short. This option is much better than being of a size which is fixed, but too high/long, which can create an unsafe environment and may not be adjustable. The unit may also be made with a shorter size and stroke, depending on its intended use and deployment (for example, a 10" stroke may be adequate to dislodge seized or stuck casing dog nuts, hangers or other downhole equipment. There are cases where rig space height is not controllable. A support structure (subfloor, basket) may be added to support a worker at a height above the rig floor. Other benefits of a short, more compact and demountable unit include:

(a) Easier handling for transportation;

(b) Easier handling with rig up and rig out saves rig time cost;

(c) Allows end users to carry the unit with them;

(d) Cheaper transportation costs (mass, size);

(e) Unit will fit through and on existing rig floors without modification;

(f) Can be transported in a vehicle as small a ¾ ton pickup truck;

(g) Can be mounted and transported on a small trailer.

As higher longitudinal compressive forces are applied to tubing, the tubing becomes susceptible to buckling and bending, forcing a requirement to engineer a solution—higher strength and thicker walled (heavier) tubing can be used, but an alternative is to provide a guide/support system surrounding the tubing to prevent it from deforming in shape or deviating from vertical (buckling or bending). Added tubing support can be provided with this invention by closing the U-shaped plates with a locking gate to make a "cage", or by (for example) deploying an expandable/contractable, preferably telescoping, pipe-shaped guide surrounding the tubing from about the point of application of downward force down to about where the tubing is supported (against bending forces) by the wellbore's interior surface. This feature can be added, optionally, to the apparatus of the invention.

DETAILED DESCRIPTION OF THE INVENTION

Figure 1:
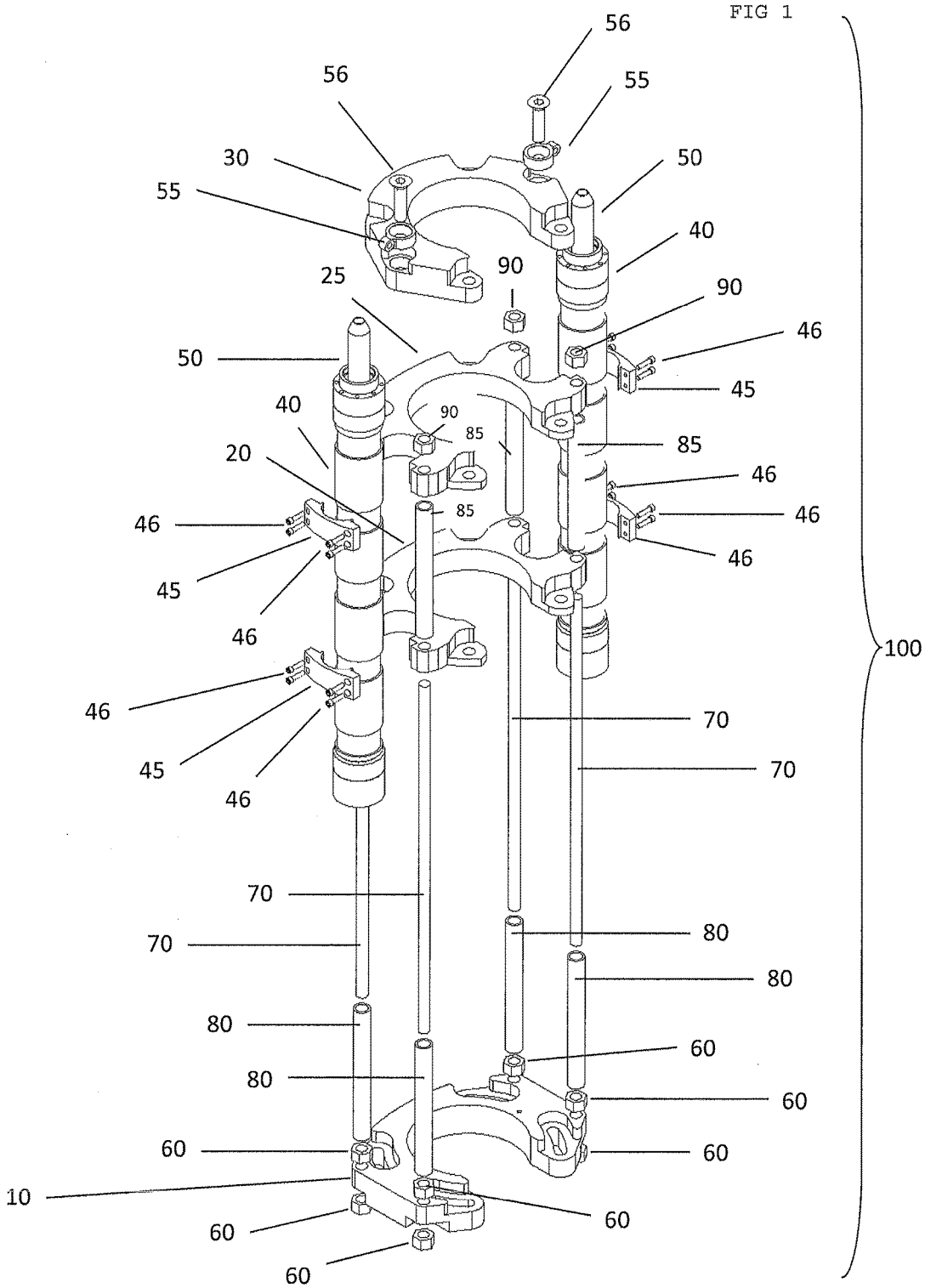
FIG. 1 is an exploded view of the main components of the apparatus of the invention.
Figure 2:
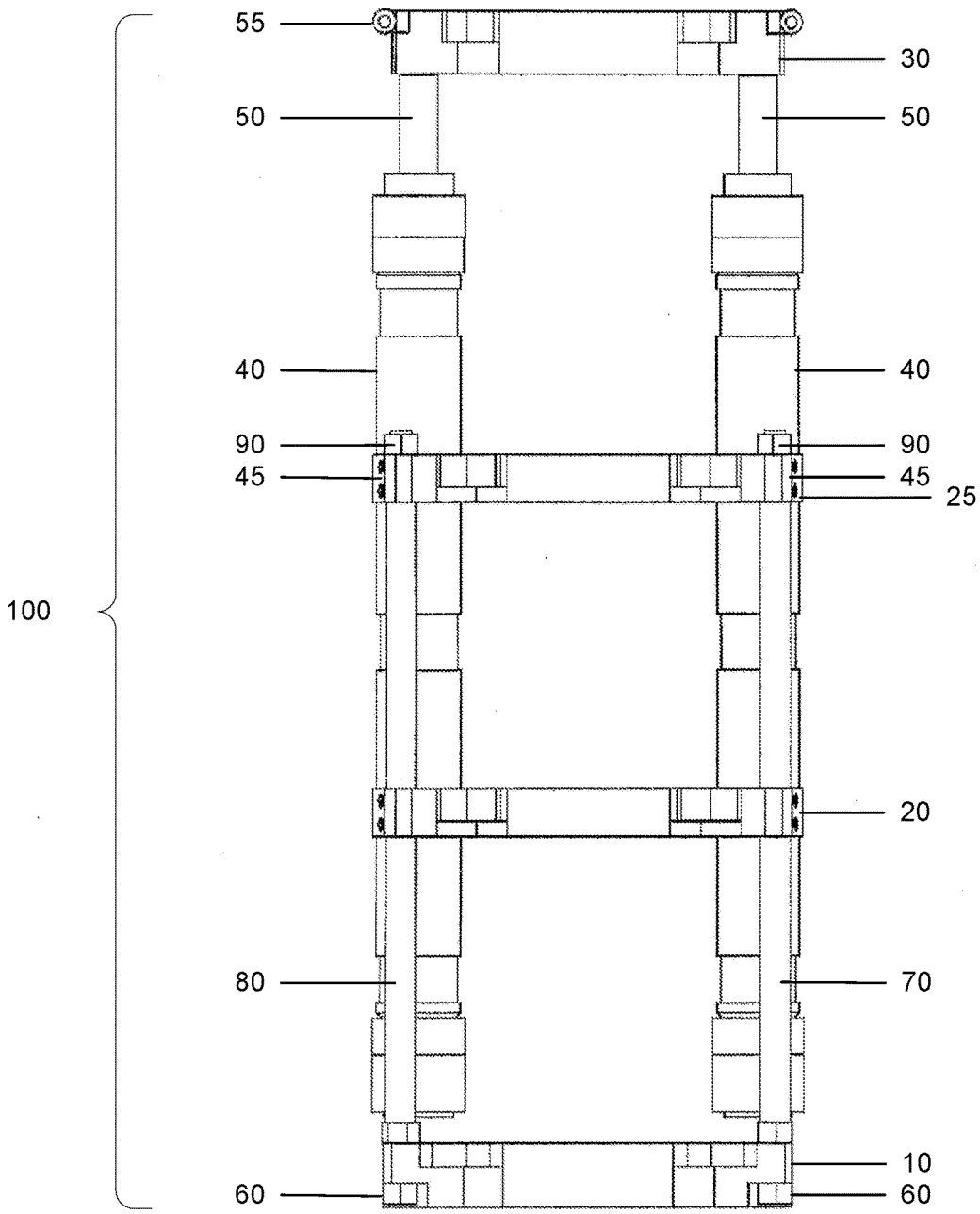
FIG. 2 is a side elevation of the apparatus from directly opposite the opening of the U-shaped mounting plates.
Figure 3:
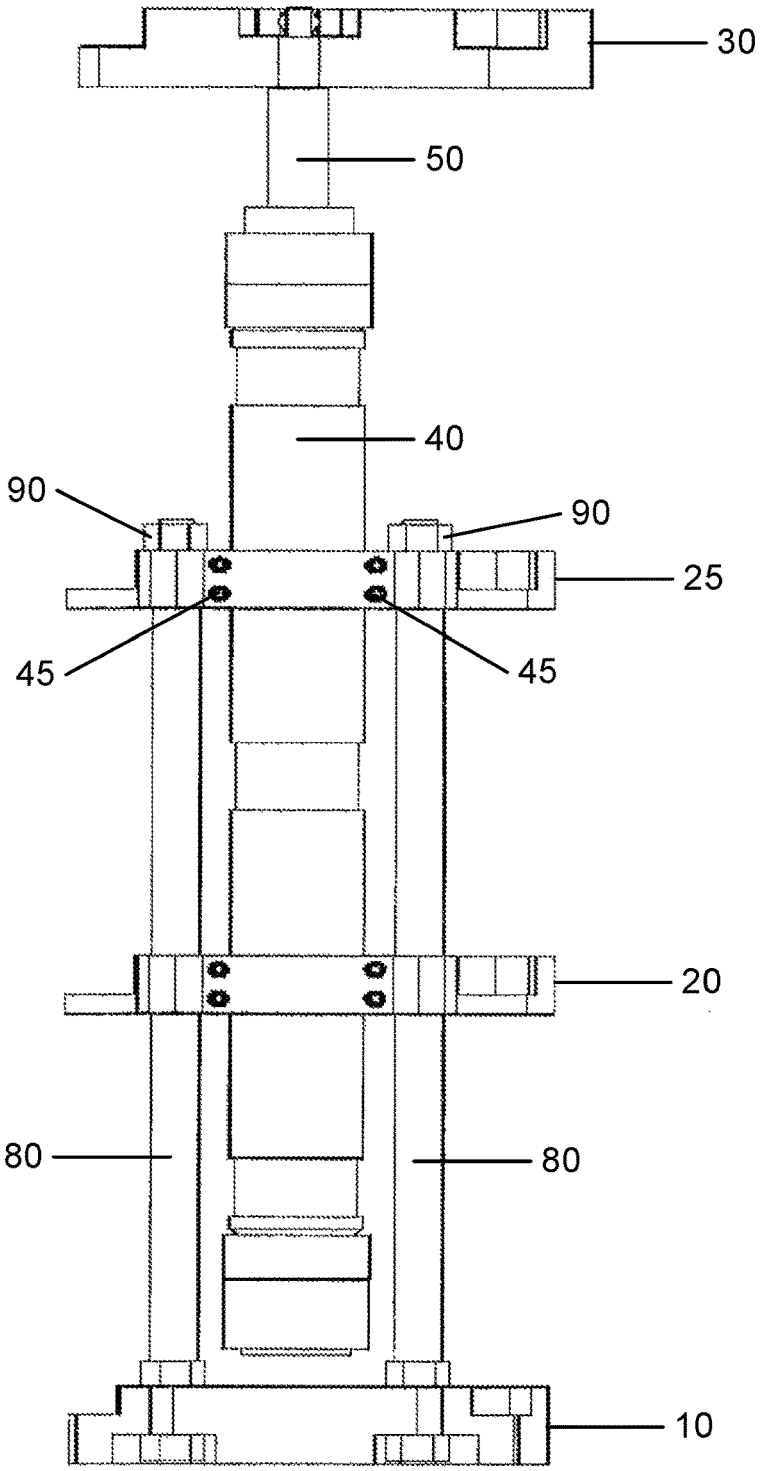
FIG. 3 is a side elevation of the apparatus from 90° (on the horizontal plane) from FIG. 2.
Figure 4:
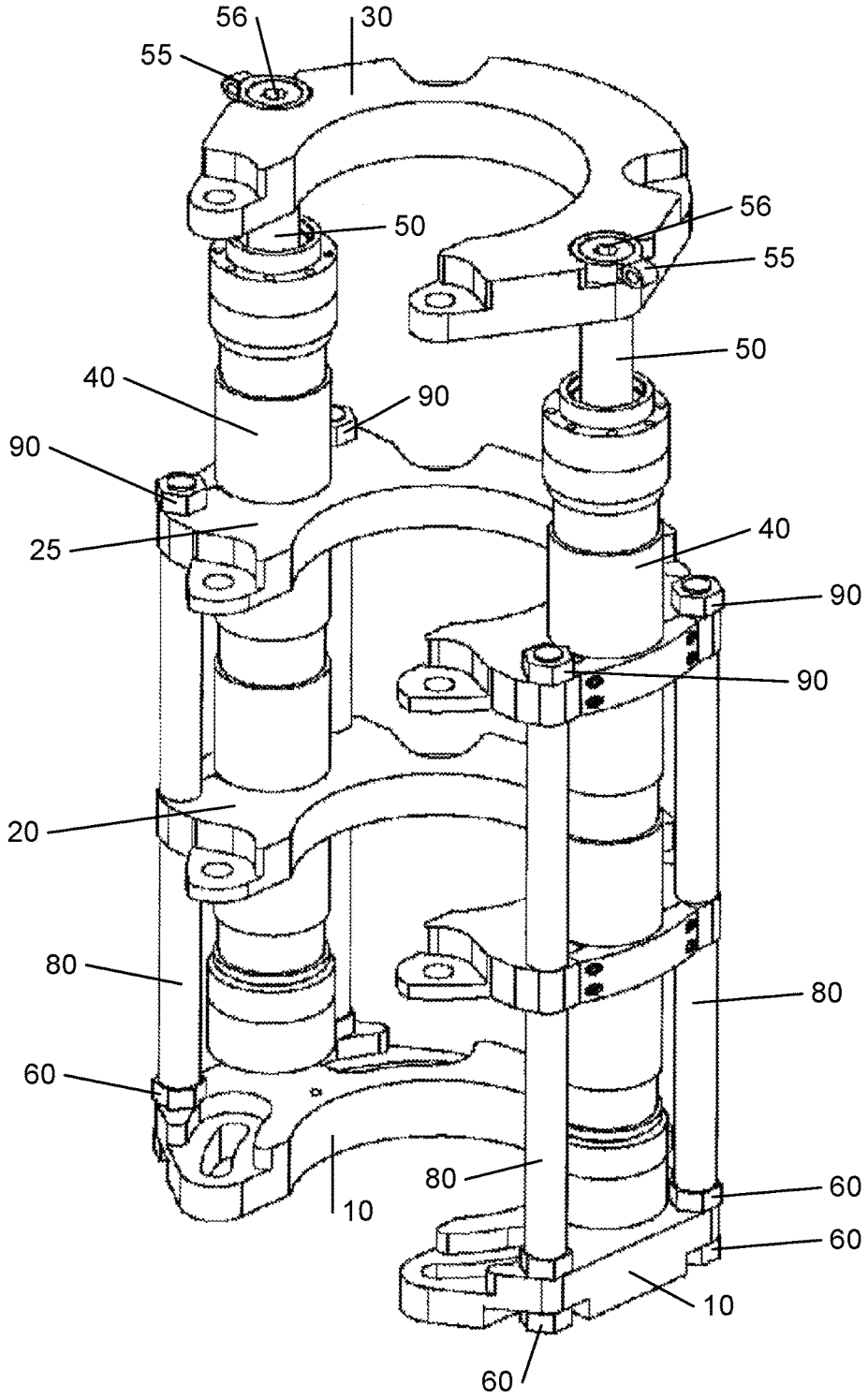
FIG. 4 is a 3D perspective of the apparatus, assembled.
Figure 5:
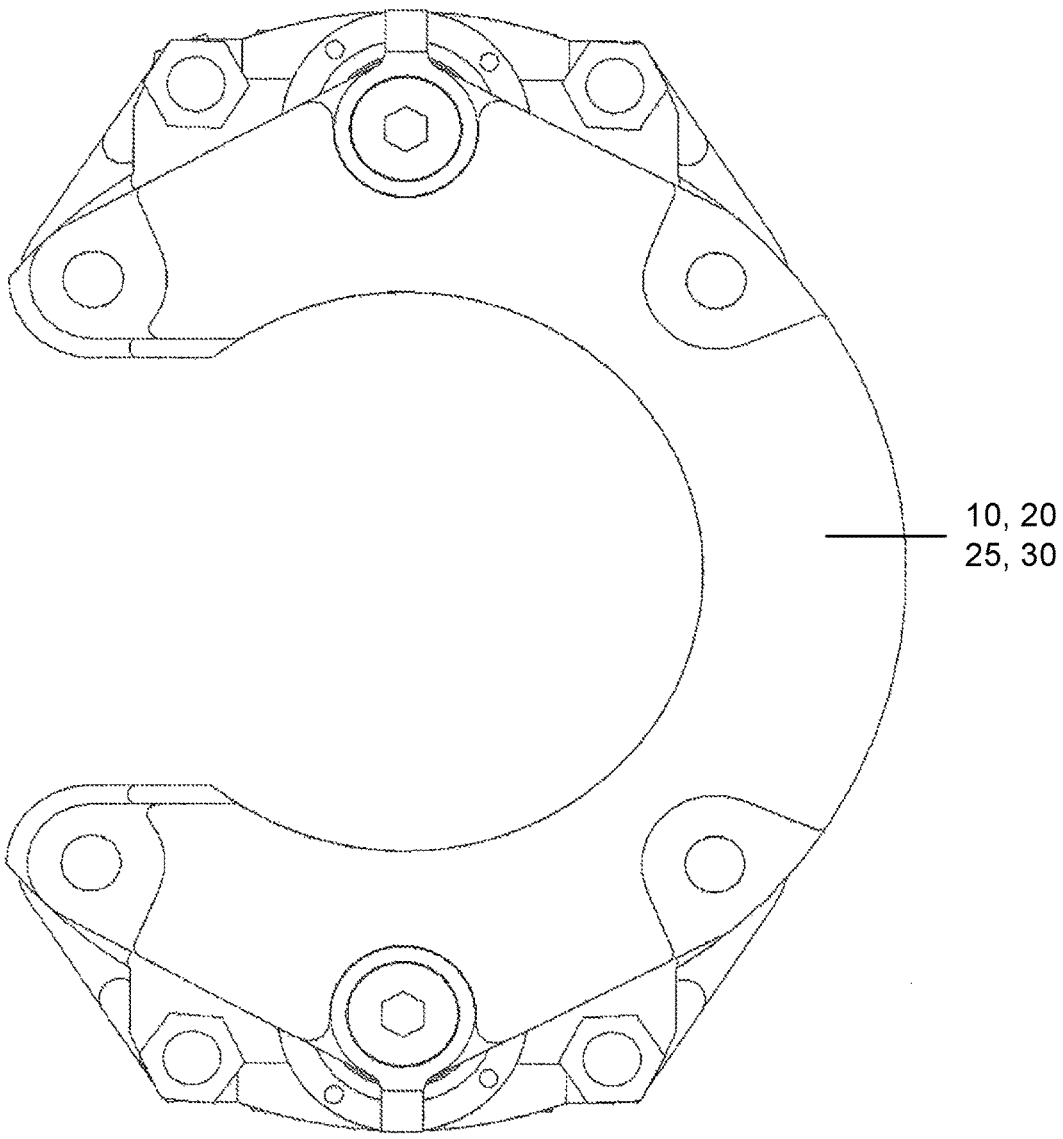
FIG. 5 is a top elevation of an example mounting plate.

The following description is of preferred embodiments by way of example only and without limitation to the combination of features necessary for carrying the invention into effect. References is to be had to Figures in which identical reference numbers identify similar components. The drawing figures are not necessarily to scale and certain features are shown in schematic form in the interest of clarity and conciseness.

A parts list with drawing reference numbers is provided here:

| | |
|---|---|
| 10 | Lower (interchangeable) Structure Plate |
| 20 | Adjustable Mid-section Structure Plate |
| 25 | Adjustable Mid-section Structure Plate (second) |
| 30 | Travelling Plate, or Top Plate |
| 40 | Hydraulic Ram Cylinder |
| 45 | Ram Cylinder Mounting Bracket |
| 46 | Bolts or Fasteners (removable) |
| 50 | Hydraulic Ram Piston |
| 55 | Ram Unit Lifting Lug |
| 56 | Ram Piston Mounting Bolt |
| 60 | Structural Tie-Rod Nuts/Fasteners (lower) |
| 70 | Structural Tie-Rods |
| 80 | Lower Compression Spacer Tubes |
| 85 | Upper Compression Spacer Tubes |
| 90 | Structural Tie-Rod Nuts/Fasteners (upper) |
| 100 | Horseshoe Jack (whole apparatus) |

Assembly

In a preferred embodiment, a compact Horseshoe Jack apparatus/assembly 100 is provided, comprising a Lower Structure Plate 10 which is directly or indirectly fastened for operation to a BOP or wellhead mount (not shown) at a drilling or service rig (not shown). Fixed to the Lower Structure Plate 10 are Structural Tie Rods 70 by fasteners such as nuts 60. Lower Compression Tubes 80 are placed over the Structural Tie Rods 70, between the Lower Structure Plate 10 and Mid-section Structure Plate 20, which is placed over Structural Tie Rods 70, which are inserted in holes through the Plate 20. In Horseshoe Jacks with additional Mid-section Structure Plates (in this case the example will have one additional Mid-section Structure Plate 25, although more can be stacked onto longer Tie Rods 70 with additional Compression Tubes 80, 85 for taller/longer-stroke Horseshoe Jack 100 assemblies, or shorter rods and fewer or shorter compression tubes and mid section plates can be used to shorten the device), a second set of Compression Tubes 85 and a second Mid-section Structure Plate 25 are placed over Tie Rods 70 (in that order, using the same hole pattern, same assembly procedure as Plate 20), and then a fastener or bolt 90 is used to tighten each Tie Rod 70 compressing the Compression Tubes 80, 85 and Mid-section Structure Plate(s) 20 (25) to the Lower Structure Plate 10, making up the lower part of the Horseshoe Jack, which is during operation mounted, directly or indirectly, to the wellhead or BOP of a well, and to which a hydraulic ram (or other jack system providing linear force and extension/retraction) or ram/jack set, is attached: to each side of the Mid-section Structure Plate(s) 20 (25) in this embodiment is attached a Hydraulic Ram Cylinder 40, preferably with a Mounting Bracket 45 and fasteners such as Bolts 46; by affixing the Ram's Cylinder 40 to the lower part of the Horseshoe Jack, the Hydraulic Ram's static component is fixed, in operation, relative to the wellhead or BOP. The moving part of the Hydraulic Ram (in this example, the Piston 50), or of each Ram 40, 50 on each side of the Mid-section Structure Plate(s) 20 (25), is attached using (for example) a Ram Unit Lifting Lug 55 and Mounting Bolt 56 to a Top Plate or Travelling Plate 30, which in turn can be attached to and detached from tubing, using conventional means such as slips or tongs or other gripping devices or techniques (not shown).

Deployment, Removal

Since the overall cross-section of the Horseshoe Jack 100, viewed as a horizontal plane intersecting the Horseshoe Jack's vertical longitudinal axis, is U-shaped, providing access from outside the Plates' surrounding material to the centre of the Plates' internal open areas, it is apparent that the Horseshoe Jack 100 can be moved into place to surround a tubular which is in place through a rig's floor, without clearing the floor over the wellhead or BOP. In operation, this means that the Horseshoe Jack 100 can be deployed on a rig at any time during operations without removing or suspending the tubing string with a complex series of steps, by simply sliding the Horseshoe Jack 100 over top of the wellhead or BOP and fastening the Lower Structure Plate 10 to the wellhead or BOP, with the Horseshoe Jack surrounding the tubing string (if it is in place) without having had to hang the string with traditional strip-on procedures to permit a circular cross-section jack to be stripped on or over the tubing. Similarly, the Horseshoe Jack can be removed from the rig without making special efforts to suspend or remove the tubing string by unfastening the Lower Structure Plate 10 and moving the Horseshoe Jack to another area of the rig away from the working area of the rig's floor.

The Horseshoe Jack 100 can be used as a powered jack to inject tubing or to add pulling power to remove tubing from the well by providing conventional hydraulic pressure to the Hydraulic Ram(s) 40, 50 either from a rig's source or from an auxiliary hydraulic system, each of which is conventional, well-understood and readily available.

In Use

In operation, in one embodiment, linear force is provided by the Hydraulic Ram(s) 40,50 exertion of force to extend or retract the Piston(s) 50, either shortening or lengthening the overall distance between the Lower Structure Plate 10 attached to the wellhead or BOP, and the Top or Travelling Plate 30, which in operation would be attached to the tubing string. This linear force is applied to inject tubing into or retrieve tubing from the wellbore through the wellhead or BOP apparatus. The entire Horseshoe Jack is demountable, portable, unobtrusive on the rig floor, and easy to transport and re-use on other rig sites.

In another use, the Horseshoe Jack can provide jamming or jolting forces to the tubing string to loosen or aid in loosening, stack tubing or equipment, without stressing or damaging the rig's elevator, cabling, pulley, top-drive or other intricate or expensive equipment.

Means to power the linear movement of the Travelling Plate 30 by moving the Piston(s) 50 in the Cylinder(s) 40 is provided, so that the apparatus 100 can be extended in length or retracted to reduce its length, thus moving the Travelling Plate 30 away from (when apparatus is extended) or closer to (when apparatus is retracted) the wellhead or BOP to which the device is attached in operation (not shown).

In an embodiment, the means to power that movement is provided hydraulically.

Forced movement of Travelling Plate 30 toward or away from the wellhead effects a linear jacking force; the jacking force is applied by fixtures on the Travelling Plate 30 (not shown) to tubing which is injected or removed into or from the wellbore through the apparatus' U-shaped Plates (10, 20, 25, 30).

Slips which frictionally engage tubing, for example, can be attached to Travelling Plate 30, and can be temporarily engaged with tubing extended through the apparatus during either a retraction or extension of the apparatus, resulting in linear force being applied by the apparatus to the tubing, forcing it either into (if during contraction) or out of (if during extension) the wellbore through the wellhead.

Slips may optionally be deployed between the wellhead and Lower Structure Plate 10 if it is desirable to control tubing during extraction from the wellbore if, for example, wellbore conditions overcome gravity on tubing forces and tend to eject tubing from the well during some phase of operations manipulating the tubing into or out of the wellbore using the Horseshoe Jack device of this invention.

Unless otherwise specified, it is preferred that the components of the invention be made of steel or other suitable high strength materials capable of taking stresses and strains during its intended use during well operations.

In the embodiment described, the Horseshoe Jack apparatus 100 may be comprised of stationary ((lower) optional) and traveling (upper) slips (not shown) attached to fixed and travelling Plates (10 and 30), respectively. In fact, gripping devices can be provided at any of the Plates to grip tubing or casing.

In the preferred embodiment, the apparatus 100 does not comprise any seal management component such as an annular or stripping head.

In the apparatus 100, a the space within the U-shape defined by the Plates 10, 20, 25, 30 may range in any size suitable to permit passage of tubing and associated joints and componentry therethrough, or tubular casing. The outside diameter of the apparatus 100 will be determined by the combination of the desired passage size and the size of hydraulic power equipment (and thus relative piston sizes) required to provide the force to be supplied by the apparatus to inject or control the tubing during manipulation into and out of the well. The hydraulic or other power supply will also determine the forces on the tubing. Those forces will also influence the size of the components, rods, compression tubes, and plates of the device 100.

When tubing or casing is to be forced into a deviated (friction locked) well one or more sets of stationary inverted or similar slips (not shown) might be required to minimize tubing recoil. This added slip would optimize the stroke of the apparatus 100, thus making the unit even more economical.

In some situations, the drill operator may wish to turn the tubing during injection or stripping operations at the same time as the operator wishes to apply the linear jacking forces of this invention. In those cases, a bearing can be provided to one of the plates, preferably the top or Travelling Plate, for fixing the device to the tubing via slips or tongs, which would be permitted to rotate with the tubing while being held in a linear direction to the device.

The apparatus of this invention provides alternatives to and improvements over, conventional snubbing systems. The invention's apparatus is optimally mounted at the rig floor and, therefore, allows live well operations to be conducted at the rig floor rather than in elevated work baskets as is generally the case with conventional snubbing units.

Prior art push/pull systems are designed for other special purposes (including control of high pressures), and are bulkier and limited as to tubing/casing sizes that they can handle. In addition, the U-shape of the Plates 10, 20, 25, 30 of the device 100 permit mounting and demounting of the Horseshoe Jack 100 on the rig in many more conditions than conventional prior art equipment, and its small size provides a degree of portability not typical in prior art snubbing equipment.

The invention claimed is:

1. A horseshoe apparatus for manipulating tubing or casing or associated fittings into or out of a well, comprising:

(a) a first mount for connecting the apparatus either directly or indirectly to a wellhead associated with the well, the mount having a U-shaped passage through which the tubing or casing and any associated fittings fit;

(b) at least one linear jack with two ends, a first end of which is fixed to an upper side of the first mount;

(c) a travelling second mount with a U-shaped passage into and through which the tubing or casing and any associated fittings fit, fixed to a second end of the at least one linear jack, and to which tube-gripping slips are attachable for periodically engaging the tubing or casing during portions of the apparatus' operation; and (d) means for powering linear extension or contraction of the jack to alter the distance between the first and second mounts while the tubing or casing and associated fittings are within the U-shaped passages of the mounts, said passages being in substantial vertical alignment, and in working alignment with the wellhead.

2. The apparatus of claim 1 where the linear jack is a hydraulic ram, and the means for powering the linear expansion or contraction of the hydraulic ram is provided by injection or release of pressurized fluid from at least one portion of the ram's cylinder.

* * * * *